United States Patent [19]

Dorion

[11] Patent Number: 4,752,256

[45] Date of Patent: Jun. 21, 1988

[54] BOAT PROPULSION DEVICE

[75] Inventor: Guy Dorion, Quebec, Canada

[73] Assignee: Florence Courcy Durand, Quebec, Canada

[21] Appl. No.: 937,358

[22] Filed: Dec. 3, 1986

[30] Foreign Application Priority Data

Oct. 30, 1986 [CA] Canada ..... 521866

[51] Int. Cl.[4] ..... B63H 21/26

[52] U.S. Cl. ..... 440/49; 30/122; 30/276; 56/2; 56/DIG. 9; 172/14; 172/247; 172/253; 440/900

[58] Field of Search ..... 440/53, 75, 78, 83, 440/49, 6, 113, 900; 30/122, 276, 500, 347; 56/2, DIG. 9; 415/122 R, 123; 416/146 R, 169 R, 32; 403/1; 172/14, 111, 120, 247, 253

[56] References Cited

U.S. PATENT DOCUMENTS

| | | | |
|---|---|---|---|
| 860,251 | 7/1907 | Schmoele | 440/900 |
| 2,513,050 | 6/1950 | Pugh | 440/53 |
| 4,179,805 | 12/1979 | Yamada | 30/122 |
| 4,188,719 | 2/1980 | Hoff | 30/122 |
| 4,242,794 | 1/1981 | Peterson | 30/122 |
| 4,271,781 | 6/1981 | Cowie | 440/113 |
| 4,286,675 | 9/1981 | Tuggle | 30/276 |
| 4,501,332 | 2/1985 | Straayer | 172/41 |
| 4,604,067 | 8/1986 | Roberts | 30/122 |

*Primary Examiner*—Joseph F. Peters, Jr.
*Assistant Examiner*—Clifford T. Bartz
*Attorney, Agent, or Firm*—Cushman, Darby & Cushman

[57] ABSTRACT

The present invention relates to an adapter for converting a conventional apparatus used for cutting and trimming vegetation into a device for propelling a boat. The adapter includes a screw propeller mounted to a centrifugal clutch which is driven by the motor of the apparatus for cutting and trimming vegetation.

13 Claims, 2 Drawing Sheets

10
12
14
16
18
20
22
24
26
28
30
32
34
36
38
44
54
60
62
64
66

BOAT PROPULSION DEVICE

FIELD OF THE INVENTION

The present invention relates to an adapter for converting a conventional apparatus for cutting and trimming vegetation into a device for propelling a boat.

FIELD OF THE INVENTION

Hand portable apparatuses for cutting and trimming vegetation are well known. Such apparatuses typically comprise a compact internal combustion motor mounted at one end of a hollow casing which carries at an opposite end thereof a vegetation cutting tool such as a cutting head with a plurality of flexible strings or a metallic circular blade for heavy duty works. The internal combustion motor drives the blade or the cutting head through an elongated drive shaft contained in the hollow casing. The lower end of the drive shaft is connected to the vegetation cutting tool by a coupling such as an universal joint.

In recent years, attempts have been made to convert commercially available vegetation trimming apparatuses into devices to perform other functions. For example, United States patent to PETERSON, U.S. Pat. No. 4,242,794, granted on Jan. 6, 1981 relates to a blower attachment unit to be mounted on a flexible line type weed trimming apparatus, to convert the trimming apparatus into a blower for sweaping sidewalks or other surfaces from clippings and the like. Also, United States patent to STRAAYER, U.S. Pat. No. 4,501,332 granted on Feb. 25, 1985, teaches an adapter for converting a portable apparatus for cutting and trimming vegetation into an earth cultivating device. However, to the best knowledge of the present inventor these are the only attempts to convert portable vegetation trimming and cutting apparatuses into devices for performing other functions.

OBJECTS AND STATEMENT OF THIS INVENTION

An object of this invention is an adapter for converting a portable apparatus normally used for cutting and trimming vegetation into a device for propelling a boat.

The adapter according to this invention comprises a centrifugal clutch to which is operatively connected a screw propeller. The centrifugal clutch is mounted to the apparatus for cutting and trimming vegetation in place of the vegetation cutting tool and the shaft coupling by releaseable securing means, which in one embodiment comprises an elongated sleeve mounted on the clutch housing and having one end received within the elongated casing of the apparatus for cutting and trimming vegetation. A conventional tightening collar is applied on the elongated casing for clamping the sleeve therein.

To mount the boat propelling device, according to this invention, to the stern of a boat a bracket may be used which allows the boat propelling device to pivot about two normal axes, namely a horizontal axis for steering the boat, and a vertical axis to lift the propeller out of the water, when desired.

Therefore, the present invention comprises in a general aspect an adapter means for converting a conventional apparatus used for cutting and trimming vegetation into a device for propelling a boat, the apparatus comprising:

(a) an internal combustion motor unit;

(b) an elongated drive shaft having one end operatively connected to the internal combustion motor unit;

(c) an elongated casing receiving the drive shaft and being attached to the internal combustion motor unit;

(d) handle means mounted to the elongated hollow casing and being spaced from the internal combustion motor unit; and (e) vegetation cutting means such as a blade or the like operatively connected to an opposite end of the drive shaft, the internal combustion motor unit being adapted to drive the vegetation cutting means through the drive shaft for cutting the vegetation, the adapter means including:

(1) a centrifugal clutch;

(2) a propeller operatively connected to the centrifugal clutch; and (3) securing means for releasably attaching the centrifugal cluth to the elongated casing, the adapter means being adapted to be mounted to the elongated housing and to be operatively connected to the drive shaft in place of the vegetation cutting tool for converting the apparatus for cutting and trimming vegetation into the device for propelling a boat, the centrifugal clutch being adapted to be releasably mounted to the elongated casing by the securing means and to be operatively connected to an opposite end of the drive shaft, the device for propelling a boat being adapted to be mounted to a boat, the centrifugal clutch and the propeller being immersed in the water, the internal combustion motor unit extending outside the water and driving the propeller through the drive shaft and the centrifugal clutch to propel the boat.

The invention also encompasses a boat propulsion unit, comprising:

a power unit, including:

(a) an internal combustion motor;

(b) an elongated casing mounted to the internal combustion motor; and (c) an elongated drive shaft having one end operatively connected to the internal combustion motor, the elongated drive shaft being mounted within said elongated casing, the power unit being normally adapted to drive a vegetation cutting tool such as a blade or the like, the vegetation cutting tool being adapted to be operatively connected to an opposite end of the elongated drive shaft and forming with the power unit a conventional apparatus used for cutting and trimming vegetation;

a centrifugal clutch releasably mounted to the elongated casing and being operatively connected to the opposite end of said elongated drive shaft in place of the vegetation cutting tool;

a propeller operatively connected to the centrigugal clutch, the boat propulsion unit being adapted to be mounted to a boat, the centrifugal clutch and the propeller being immersed in the water, the internal combustion motor extending outside the water and driving the propeller through the elongated drive shaft and the centrifugal clutch for propelling the boat.

DESCRIPTION OF A PREFERRED EMBODIMENT

A preferred embodiment of the adapter according to the present invention will now be described with reference to the annexed drawings in which.

Figures 1, 2, 3, 4:
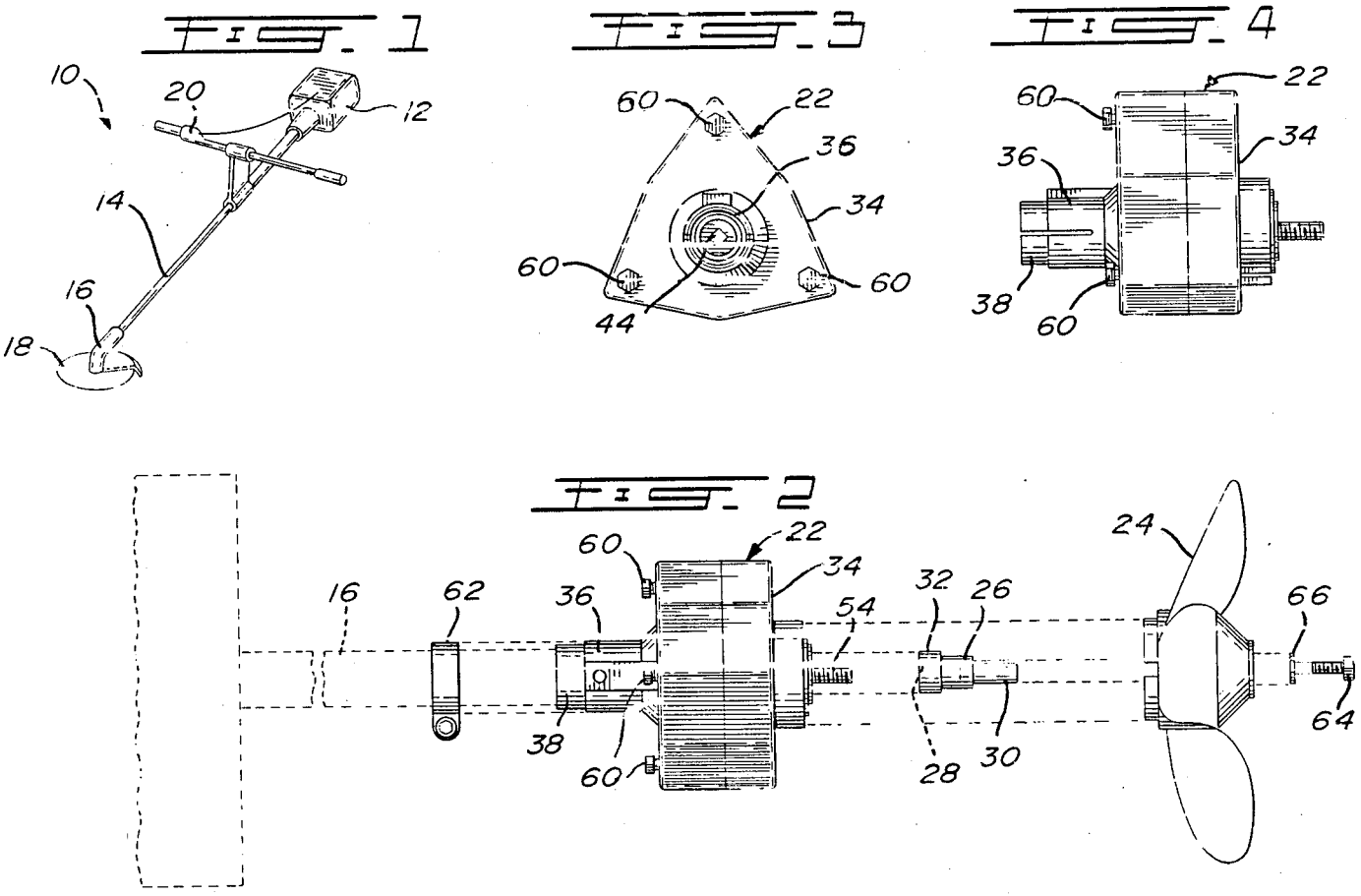
FIG. 1 is a perspective view of a conventional apparatus for cutting and trimming vegetation, provided with a circular cutting blade.
FIG. 2 is an exploded view of a adapter according to the present invention mounted to an apparatus for cutting and trimming vegetation which is schematically shown in dotted lines.
FIG. 3 is a rear view of the centrifugal clutch illustrated in FIG. 2.
FIG. 4 is a side view of the centrifugal clutch of FIG. 3.

A conventional apparatus 10 for cutting and trimming vegetation is shown in FIG. 1. The apparatus 10 comprises an internal combustion motor 12 secured at one end of an elongated hollow casing 14 containing an elongated drive shaft (not shown). At an opposite end of casing 14 is mounted a shaft coupling 16, such as an universal joint or the like, driving a vegetation cutting tool. The vegetation cutting tool may be a circular metallic blade 18, for heavy duty works, or a cutting head (not shown) with a plurality of radially outwardly extending flexible strings.

The shaft coupling 16 is necessary since the blade 18 and the drive shaft contained in casing 14 rotate about non-collinear axes. However, there exists on the market vegetation trimming and cutting apparatuses using a flexible drive shaft mounted in a hollow casing bent substantially at mid-portion at an obtuse angle to bring the vegetation cutting tool in a horizontal plane. With such an arrangement, the lower end of the flexible drive shaft and the vegetation cutting tool rotate about the same axis and do not require an universal joint or the like therebetween. Yet, a simplified coupling may still be used to facilitate the connection of the vegetation cutting tool to the drive shaft.

A handle 18 mounted on hollow casing 14 is spaced from the internal combustion motor 12 and comprises the controls for the internal combustion motor 12.

Referring to FIG. 2, the adaptor according to the present invention comprises a centrifugal clutch 22 to which is connected a screw propeller 24 by a coupler 26. Coupler 26 comprises two opposite threaded openings 28 and 30, respectively and a tool engaging head 32.

Centrifugal clutch 22 includes a clutch housing 34 from which projects a sleeve 36 definng at its free end a neck 38.

Figure 5:
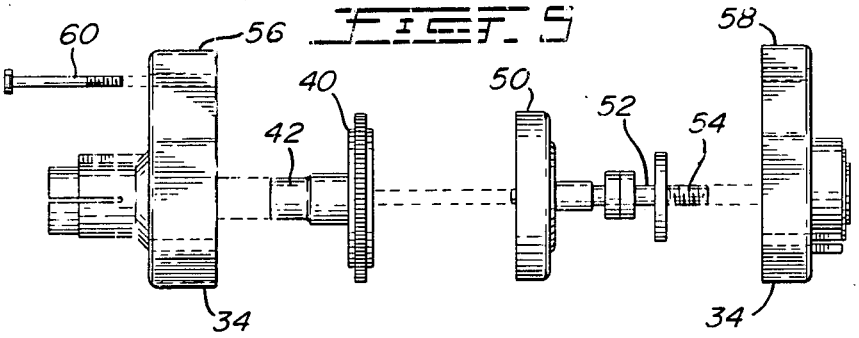
FIG. 5 is an exploded view of the centrifugal clutch shown in FIG. 4.
Figure 6:
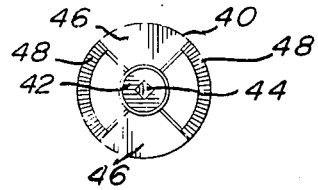
FIG. 6 is a plan view of the driving rotor of the centrifugal clutch shown in FIG. 5.

The clutch mechanism of centrifugal clutch 22, shown in FIGS. 5 and 6 and comprises a driving rotor 40 with a hub 42 provided with a square socket 44. Rotor 40 comprises two friction blocks 46 connected to each other by a coil spring 48.

A drum 50 which encompasses disc 40 is provided with a shaft 52 comprising a threaded end 54. Disc 40 and drum 50 are received within clutch housing 34 constituted by two portions 56 and 58, connected to each other by bolts 60.

When rotor 40 is driven at a speed exceeding a predetermined level, friction blocks 46 will extend radially outwardly under the influence of the centrifugal force and frictionally engage drum 50 to establish a driving connection between the drum 500 and the power source. When the speed of rotation of rotor 40 drops below the predetermined level, coil spring 48 will retract friction blocks 46, breaking contact with drum 50 and disengaging the latter from the power source.

The screw propeller 24 is mounted on the centrifugal clutch 22 by the coupler 26 screwed on threaded end 54. The propeller 24 is mounted on coupler 26 and secured thereon by a bolt 64 and a washer 66.

To mount the adaptor, according to the present invention, to the conventional apparatus 10 for cutting and trimming vegetation, the blade 18 and the coupling 16 are removed from apparatus 10 exposing the lower end of the drive shaft which has a square cross-section. Then, the lower end of the drive shaft is mounted within socket 44 and the neck 38 of the sleeve 36 is received within casing 14. A conventional tightening collar 62 is mounted on the lower end of casing 14 to prevent an unwanted removal of neck 38 therefrom.

The modified apparatus 10 which receives the clutch 22 and the propeller 24, mounted in place of blade 18 constitutes a boat propulsion device which is adapted to be mounted to a boat, the clutch 22 and propeller 24 being immersed in the water, the internal combustion engine 12 extending outside the water. Preferably, the housing of the centrifugal clutch 22 should be watertight by proving the adequate seals, since the clutch 22 continually operates under water.

Figure 7:
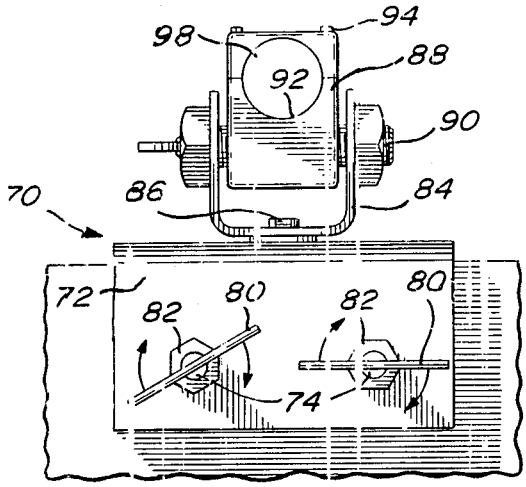
FIG. 7 is an elevational view of a bracket for mounting the boat propulsion device, according to this invention, to the stern of a boat.
Figure 8:
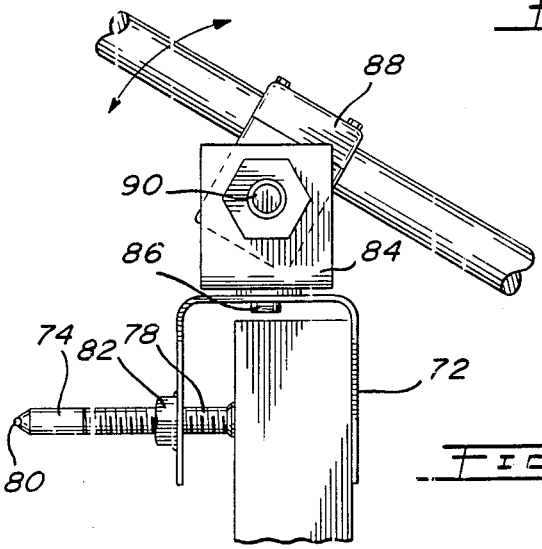
FIG. 8 is a side view of the bracket shown in FIG. 8.

A bracket for mounting the boat propulsion device, according to this invention, to the stern of a boat, is shown in FIGS. 7 and 8. The bracket, generally designated by the reference numeral 70, comprises a U-shaped base member 72 secured to the stern 74 of a boat by two clamps 76. Each clamp 76 is constituted by a threaded rod 78 having secured thereto a handle 80 and being engaged in a nut 82, welded on otherwise secured to base member 72.

A U-shaped yoke member 84 is rotatably mounted about a vertical axis by means of a bolt 86 to base member 72. A connecting block 88 is pivotably mounted about a horizontal axis to yoke member 84 by bolt 90. Block 88 is constituted by two separable portions 92 and 94 connected to each other by bolts 96 and defining a circular opening 98 adapted to receive the elongated casing 14 of the boat propulsion device.

When the boat propulsion device is mounted to the stern 74 of a boat by means of bracket 70, it may pivot with respect to the stern about a vertical axis for steering the boat and may also pivot about a horizontal axis to lift the propeller 24 out of the water, when required. For removing the boat propulsion device from the boat, clamps 74 are unscrewed to disengage the base member 72 from the stern.

Although the invention has been described in relation to preferred forms, it will be evident to the person skilled in the art that it may be modified and refined in various ways. It is therefore wished to have it understood that the present invention should not be limited into interpretation except by the terms of the following claims.

I claim:

1. An adapter means for converting a conventional apparatus used for cutting and trimming vegetation into a device for propellng a boat, said apparatus comprising:

(a) an internal combustion motor unit;

(b) an elongated drive shaft having one end operatively connected to said internal combustion motor unit;

(c) an elongated casing receiving said drive shaft and being attached to said internal combustion motor unit;

(d) handle means mounted to said elongated hollow casing and being spaced from said internal combustion motor unit; and (e) vegetation cutting means operatively connected to an opposite end of said drive shaft, said internal combustion motor unit being adapted to drive said vegetation cutting means through said drive shaft for cutting said vegetation, said adapter means including:

(1) a centrifugal clutch;

(2) a propeller operatively connected to said centrifugal clutch; and (3) securing means for releasably attaching said centrifugal clutch to said elongated casing, said adapter means being adapted to be mounted to said elongated housing and to be operatively connected to said drive shaft in place of said vegetation cutting means for converting said apparatus for cutting and trimming vegetation into said device for propelling a boat, said centrifugal clutch being adapted to be releasably mounted to said elongated casing by said securing means and to be operatively connected to an opposite end of said drive shaft, said device for propelling a boat being adapted to be mounted to a boat, said centrifugal clutch and said propeller being immersed in the water, said internal combustion motor unit extending outside the water and driving said propeller through said drive shaft and said centrifugal clutch to propel said boat.

2. An adapter means as defined in claim 1, wherein said centrifugal clutch comprises a clutch housing, said securing means comprising an extension mounted to said clutch housing and having a free end adapted to be received in said elongated casing.

3. An adapter means as defined in claim 1, wherein said elongated casing is adapted to receive therearound a tightening collar to clamp said extension therein.

4. An adapter means as defined in claim 1, wherein said elongated drive shaft has a square cross-section, said centrifugal clutch comprising a square socket adapted to receive an opposite end of said elongated drive shaft.

5. An adapter means as defined in claim 1, wherein said elongated casing has a substantially circular cross-section, said centrifugal clutch comprises a clutch housing which includes a sleeve having a free end adapted to be received in elongated casing.

6. A boat propulsion unit, comprising:

a power unit, including:

(a) an internal combustion motor;

(b) an elongated casing mounted to said internal combustion motor; and (c) an elongated drive shaft having one end operatively connected to said internal combustion motor, said elongated drive shaft being mounted within said elongated casing, said power unit being normally adapted to drive a vegetation cutting tool, said vegetation cutting tool being adapted to be operatively connected to an opposite end of said elongated drive shaft and forming with said power unit a conventional apparatus used for cutting and trimming vegetation;

a centrifugal clutch releasably mounted to said elongated casing and being operatively connected to said opposite end of said elongated drive shaft in place of said vegetation cutting tool;

a propeller operatively connected to said centrifugal clutch, said boat propulsion unit being adpated to be mounted to a boat, said centrifugal clutch and said propeller being immersed in the water, said internal combustion motor extending outside the water and driving said propeller through said elongated drive shaft and said centrifugal clutch for propelling said boat.

7. A boat propulsion unit, as defined in claim 6, further comprising a handle mounted on said elongated casing and being spaced from said internal combustion motor.

8. A boat propulsion unit, as defined in claim 6, wherein said centrifugal clutch comprises a clutch housing including a hollow extension having a free end received within said elongated casing.

9. A boat propulsion unit as defined in claim 8, wherein said hollow extension and said elongated casing have a circular cross-section.

10. A boat propulsion unit, as defined in claim 9, wherein said elongated casing receives therearound a tightening collar for clamping said hollow extension therein.

11. A boat propulsion unit as defined in claim 6, wherein said elongated drive shaft has a square cross-section, said centrifugal clutch comprising a square socket receiving said opposite end of said elongated drive shaft.

12. A boat propulsion unit as defined in claim 6, further comprising bracket means mounted to said elongated casing, said bracket means being adapted to be mounted to a boat.

13. A boat propulsion unit as defined in claim 12, wherein said bracket means allows said boat propulsion unit to pivot about a vertical and a horizontal axis with respect to said boat.

* * * * *